US005141188A

United States Patent [19]

DeBlasi et al.

[11] Patent Number: 5,141,188

[45] Date of Patent: Aug. 25, 1992

[54] NAIL POLISH BOTTLE CADDY

[76] Inventors: Joan M. DeBlasi, 1550 Friedensburg Rd., Reading, Pa. 19606; Robert C. McIntyre, R.D. #3, Box 143A, Birdsboro, Pa. 19508

[21] Appl. No.: 651,744

[22] Filed: Feb. 7, 1991

[51] Int. Cl.[5] ..... A47F 5/12

[52] U.S. Cl. ..... 248/142; 248/137

[58] Field of Search ..... 248/137, 138, 139, 140, 248/141, 142, 143, 130; 211/81

[56] References Cited

U.S. PATENT DOCUMENTS

| | | | |
|---|---|---|---|
| 157,945 | 12/1874 | Thomas | 248/137 X |
| 301,954 | 7/1884 | Brand | 248/142 |
| 527,334 | 10/1894 | Kammerer | 248/141 X |
| 711,339 | 10/1902 | Park | 248/141 |
| 996,658 | 7/1911 | Minor | 248/142 |
| 1,064,939 | 6/1913 | Sunkler | 248/142 |
| 2,302,756 | 11/1942 | Ficke | 248/133 X |
| 2,748,952 | 6/1956 | Fleit et al. | 248/133 X |
| 3,220,685 | 11/1965 | Himler | 248/133 |
| 3,521,846 | 7/1970 | Copony | 248/139 |
| 4,317,551 | 3/1982 | Bishop | 211/81 |

*Primary Examiner*—J. Franklin Foss
*Attorney, Agent, or Firm*—Leonard M. Quittner

[57] ABSTRACT

A nail polish caddy with a U-shaped frame for holding pivotally a rectangular tubular nail polish bottle holder snugly inserted in the tube. The holder's based is seated snugly on the frame and has a rounded edge which enables the holder to pivot in one direction only. The caddy has locking means to restrain the holder tilted at a multiplicity of defined angles.

3 Claims, 1 Drawing Sheet

NAIL POLISH BOTTLE CADDY

CROSS-REFERENCE

There are no cross-references to, nor are there any, related applications.

FEDERALLY-SPONSORED RIGHTS

The invention herein was made without any Federal sponsorship or contribution.

BACKGROUND OF THE INVENTION

1. The Field of the Invention

The field of the invention relates to an improved nail polish caddy which is capable of holding a defined dispensing angle.

2. Description of the Prior Art

Nail polish is typically a fast drying lacquer in a highly volatile solvent such as acetone and is brush applied. In consequence, the lacquer is sold in a small bottle with very small aperture to reduce evaporation. A person applying nail polish to the hand is confronted with the problem of retrieving from the bottle a very small quantity of the lacquer repeatedly. Bottle size is an annoying factor in the retrieval since the bottle is generally hand held while the brush must be. Restraining the bottle without it being hand held is desirable since it simplifies the manipulation of retrieval. Restraint of the bottle in a tilted position is even more desirable.

A solution to the problem is disclosed in U.S. Pat. No. 4,795,117 (1989 to Siteman). There a nail polish bottle is disposed tiltedly on the surface of a sand bag. If the sand bag is of sufficient mass, the bottle will be restrained. Otherwise, the user must develop a deft touch to retrieve lacquer and not upset the bottle's tilt. The result can be unsatisfactory.

SUMMARY OF THE INVENTION

Objects of the present invention are to provide a steady platform for dispensing out of a small nail polish bottle useful quantities of nail polish and to enable the user to hold the bottle at a multiplicity of angles or tilts to facilitate dripless dispensing of nail polish from the bottle onto a nail polish brush.

Accordingly, to accomplish the foregoing, the present invention is summarized as a nail polish caddy comprising a bottle holder which pivots inside a U-shaped support frame which has detents in its walls, the detents capable of arresting the holder at a multiplicity of defined angles. When the nail polish brush is inserted into the polish bottle, the bottle is held steady at an angle defined by the detents, thereby allowing the nail polish user to control removal of nail polish onto a nail polish brush in discrete dripless quantities.

Other objects, advantages and features of the present invention will be apparent to those skilled in the art from the following description taken in conjunction with the accompanying drawings.

DESCRIPTION OF THE DRAWINGS

The present invention may be better understood by reference to the drawings wherein 3 figures are shown on 1 sheet. The numbers shown on the drawings for the various parts of the invention are consistent throughout so that a number indicating a part in one drawing will indicate the same part in another drawing.

DESCRIPTION OF THE PREFERRED EMBODIMENT

Figure 1:
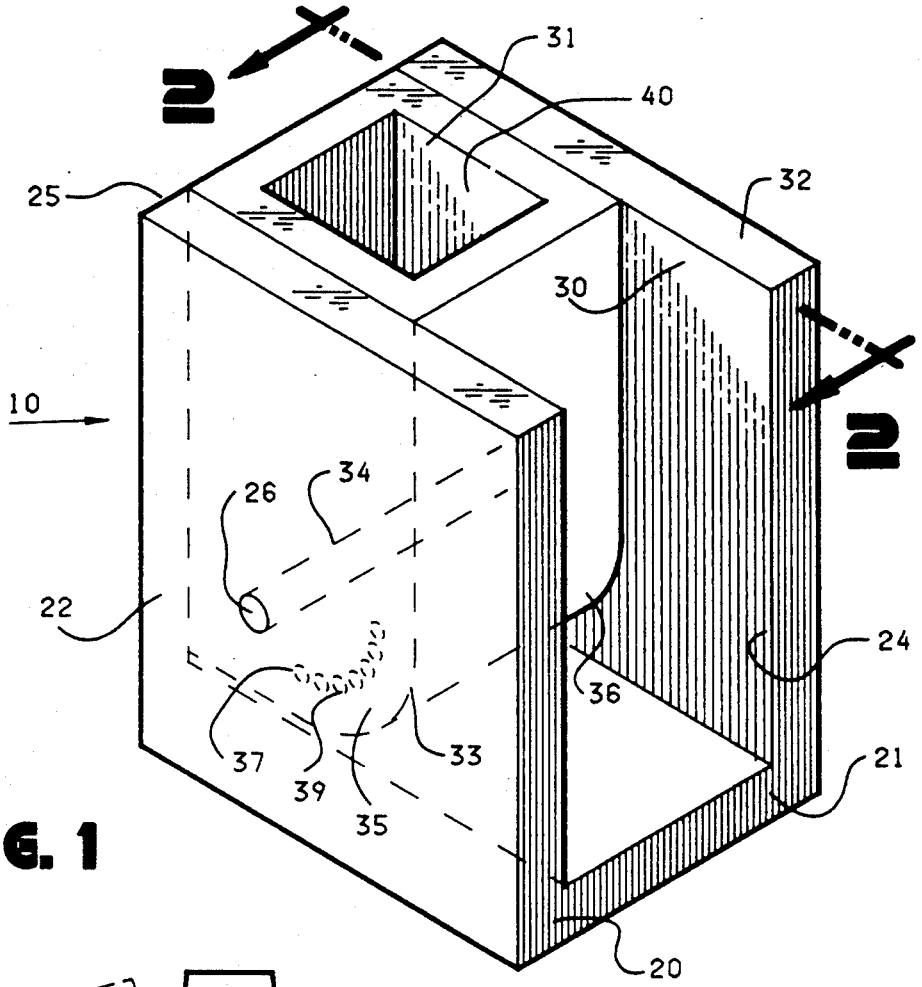
FIG. 1 shows a perspective view of the caddy.

The preferred embodiment is described as comprising a nail polish caddy 10 comprising a holding frame 20 and a nail polish bottle holder 30. The frame has a base 21 which is planar to enable it to be seated steadily on a flat surface such as a table. At right angles to the base are first 22 and second 23 walls each of substantially the same length and width and extending vertically to form in conjunction with the base a "U" and oriented on the base to form a front 24 and a rear 25 opening.

Figure 2:
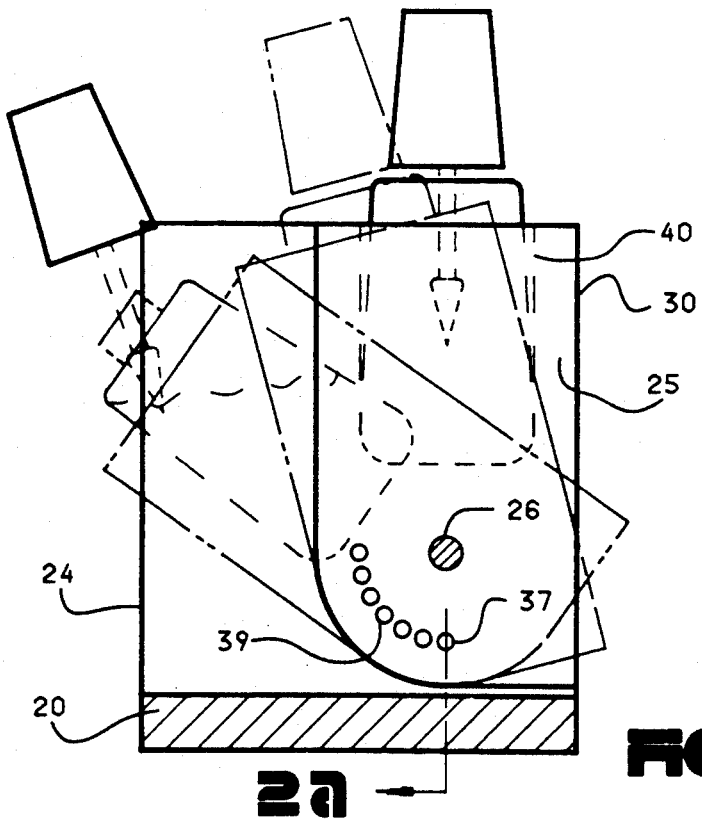
FIG. 2 is a cross-sectional elevation of the caddy through line 2—2 in FIG. 1.
Figure 2A:
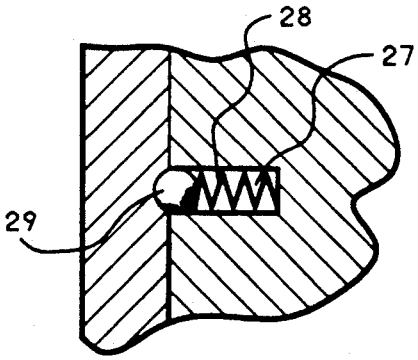
FIG. 2A is a cross-sectional view of a portion of the caddy through line 2*a*—2*a* in FIG. 2.

Disposed on the first and second wall axially opposite each other is a pair of axle holding sockets 26 disposed a defined distance above the base and situated toward the rear opening. Situated in vertical alignment with each socket and below it a defined distance on each wall is a passage 27 inserted in which is a spring 28 and arresting ball 29 means, the ball being urged by the spring outward of the passage. (See FIG. 2*a*).

The nail polish holder 30 is a rectangular tube and has an open top 31 and third 32 and fourth 33 straight-sided exterior walls which abut snugly against the frame walls rotatingly about an axle 34 set transversely in the holder's base 35 and into the sockets 26. The base has an exterior rounded surface 36 frontwards such that the holder is able to rotate toward the front opening and disabled from rotating toward the rear opening (See FIG. 2.).

Disposed a defined distance below the axle on the exterior surface of the third and fourth walls equal to the distance between the socket and ball holding passage axially opposite each other are first hemispherical detents 38 to receive the arresting balls when they are urged by the springs into the detents such that when the balls are seated in the first detents, the holder is held firmly upright at a 90 degree angle.

Radially disposed rearward on the third and fourth walls with the socket 26 as a locus and the first detent 38 defining a circumference is a multiplicity of detents 39 spaced equally apart such that the holder will be held firmly at a multiplicity of angles by the arresting ball and spring means.

The holder has a rectangular passage 40 below the open 31 top whose walls 41 are slightly tapered inwardly toward the holder base 35 such that the walls will restrain and hold snugly in a force fit a nail polish bottle inserted in the passage. It has been found that the holder can typically be made of polyethylene or a similar plastic which has some yieldability to facilitate the bottle holding or a rigid material lined with a compliant membrane of a spongy consistency.

Since many modifications, variations and changes in detail may be made to the presently described embodiment, it is intended that all matters in the foregoing description and accompanying drawings be interpreted as illustrative and not by way of limitation.

What is claimed is:

1. A nail polish caddy comprising:

(a) a frame with a planar rectangular base and a first and second wall opposite each other extending vertically from the base at right angles to form an open front side and rear side, the first and second walls having disposed thereon axially opposite each other (1) axle receiving sockets; and below each socket in vertical alignment therewith at a radius defining (2) distance a passage containing ball and spring locking means;

(b) a nail polish bottle holder which is rectangularly tubular in cross-section having third and fourth sides with inner and outer surfaces, the outer surfaces being parallel to each other and parallel and in contact with the first and second sides, the holder having (1) an enclosed bottom which defines a base through which is disposed an axle to fit pivotally in the sockets and (2) disposed vertically below the axle the radius defining distance apart a first hemispherical detent to receive the ball of the locking means such that the holder is held vertically and situated on an arc defined by the radius (3) a multiplicity of detents equidistantly apart starting with the first detent such that the holder may be pivoted and locked at defined angles from the vertical and (4) the third and fourth walls' inner surfaces being tapered toward each other and made of a yieldable material to receive and hold firmly a nail polish bottle inserted in between.

2. A nail polish caddy as in claim 1 wherein holder base is in intimate contact with the frame base when in the vertical position as defined by the first detent and is rounded accurately to permit the holder to be tilted frontward and restrained from tilting rearward.

3. A nail polish caddy as in claim 1 wherein the third and fourth walls are made of a rigid material and lined with a compliant membrane of spongy consistency.

* * * * *